US007470169B2

(12) United States Patent
Taniguchi et al.

(10) Patent No.: US 7,470,169 B2
(45) Date of Patent: Dec. 30, 2008

(54) METHOD OF POLISHING SEMICONDUCTOR WAFERS BY USING DOUBLE-SIDED POLISHER

(75) Inventors: Toru Taniguchi, Tokyo (JP); Isoroku Ono, Tokyo (JP); Seiji Harada, Tokyo (JP)

(73) Assignee: Sumitomo Mitsubishi Silicon Corporation, Tokyo (JP)

( * ) Notice: Subject to any disclaimer, the term of this patent is extended or adjusted under 35 U.S.C. 154(b) by 482 days.

(21) Appl. No.: 10/296,498

(22) PCT Filed: May 31, 2001

(86) PCT No.: PCT/JP01/04594

§ 371 (c)(1),
(2), (4) Date: Nov. 25, 2002

(87) PCT Pub. No.: WO01/91970

PCT Pub. Date: Dec. 6, 2001

(65) Prior Publication Data

US 2003/0181141 A1 Sep. 25, 2003

(30) Foreign Application Priority Data

May 31, 2000 (JP) ..... 2000-163444

(51) Int. Cl.
*B24B 1/00* (2006.01)
*B24B 7/00* (2006.01)

(52) U.S. Cl. ..... 451/36; 451/41

(58) Field of Classification Search ..... 451/36, 451/41, 63, 261, 262, 269, 291
See application file for complete search history.

(56) References Cited

U.S. PATENT DOCUMENTS

| | | | | |
|---|---|---|---|---|
| 4,586,296 | A * | 5/1986 | Saunders | 451/262 |
| 4,773,185 | A * | 9/1988 | Taira | 451/269 |
| 5,110,428 | A | 5/1992 | Prigge et al. | |
| 5,274,960 | A * | 1/1994 | Karlsrud | 451/262 |
| 5,643,405 | A | 7/1997 | Bello et al. | |
| 6,113,467 | A * | 9/2000 | Koike | 451/41 |
| 6,361,418 | B1 * | 3/2002 | Inada | 451/262 |
| 2003/0104698 | A1 | 6/2003 | Taniguchi et al. | |

FOREIGN PATENT DOCUMENTS

| | | |
|---|---|---|
| DE | 39 29 484 C2 | 3/1991 |
| DE | 196 29 756 A1 | 2/1997 |

(Continued)

*Primary Examiner*—Hadi Shakeri
(74) *Attorney, Agent, or Firm*—Kubovcik & Kubovcik

(57) ABSTRACT

During polishing of the semiconductor wafer by using a double-sided polisher, a larger difference as compared to the prior art is created between a frictional resistance acting on a front surface of a silicon wafer from an upper surface plate side and a frictional resistance acting on a back surface of the silicon wafer from a lower surface plate side. Thereby, respective wafers can be rotated at as 0.1 - 1.0 rpm within corresponding wafer holding holes. Accordingly, the rotation of the wafer would not be suspended even if there were any defective condition induced during polishing. Further, partial variation or deviation in polishing volume particular in the outer periphery of the wafer would be hard to occur. Therefore, the polish-sagging is suppressed and thus the improved degree of flatness of the wafer could be obtained.

5 Claims, 10 Drawing Sheets

FOREIGN PATENT DOCUMENTS

| | | | |
|---|---|---|---|
| JP | 31-5788 | Y1 | 4/1956 |
| JP | 50-1313 | Y1 | 1/1975 |
| JP | 5-315305 | A | 11/1993 |
| JP | 11-233462 | A | 8/1999 |
| JP | 2000-42912 | A | 2/2000 |
| JP | 2000-141213 | A | 5/2000 |

* cited by examiner

METHOD OF POLISHING SEMICONDUCTOR WAFERS BY USING DOUBLE-SIDED POLISHER

FIELD OF THE INVENTION

The present invention relates to a method of polishing semiconductor wafers by using a double-sided polisher, and in more specific, to a method of polishing semiconductor wafers by using a double-sided polisher having no sun gear incorporated thereinto, thereby suppressing the polish-sagging thus to obtain the semiconductor wafers having highly improved flatness.

DESCRIPTION OF THE PRIOR ART

For manufacturing wafers having both surfaces polished according to the prior art, a single crystal silicon ingot is sliced to be formed into silicon wafers, and then those silicon wafers are subjected to a series of processing steps of beveling, lapping and acid etching in sequence. These steps are followed by a double-sided polishing process for mirror-finishing both front and back surfaces of the wafers. This double-sided polishing typically uses a double-sided polisher having an epicyclic gear system, in which a sun gear is disposed in the central region while an internal gear is disposed in the outer periphery thereof . In this double-sided polisher, the silicon wafers are inserted and thus held in a plurality of wafer holding holes formed in a carrier plate respectively, and then the carrier plate is driven to makes a rotation and also a revolution between the sun gear and the internal gear in a state in which polishing cloths extending over the opposite surfaces of an upper and a lower surface plates are pressed against the front and the back surfaces of respective wafers, while supplying slurry to the silicon wafers from above, so that the front and the back surfaces of respective wafers are polished all at once.

As discussed above, this double-sided polisher of the epicyclic gear type includes the sun gear located in the central portion of the unit. To fabricate a set of equipment for applying the double-sided polishing to those wafers of large gauge, such as 300 mm wafers, disadvantageously the carrier plate and thus the entire unit could be enlarged by a size to accommodate the sun gear. In one example, it may lead to the fabricated equipment for the double-sided polishing that has a diameter not smaller than 3 m.

In the circumstances as described above, to solve the problems, one exemplary "double-sided polisher" as disclosed in the Japanese Patent Publication No. H11-254302 has been suggested.

This double-sided polisher comprises a carrier plate having a plurality of wafer holding holes, an upper surface plate and a lower surface plate disposed above and beneath the carrier plate respectively, with polishing cloths extending over the opposite surfaces of the upper and the lower surface plates for polishing a front and a back surfaces of the silicon wafers held in the wafer holding holes at the same polishing speed, and a carrier drive means for driving the carrier plate held between the upper surface plate and the lower surface plate to make a motion within a plane parallel with the surface of the carrier plate.

The motion of the carrier plate in the context herein means such a circular motion of the carrier plate associated with no rotation on its own axis in which the silicon wafers held between the upper surface plate and the lower surface plate are allowed to rotate in respective wafer holding holes. The rotating motion of the silicon wafer in the wafer holding hole is caused by a difference between a frictional resistance acting on the front surface of the wafer from the upper surface plate side and a frictional resistance acting on the back surface of the wafer from the lower surface plate side during polishing, respectively.

During polishing of the wafers, the silicon wafers are held in respective wafer holding holes of the carrier plate and the carrier plate is driven to make a circular motion associated with no rotation on its own axis while supplying a polishing agent (slurry) to the silicon wafers and rotating the upper and the lower surface plates, so that respective silicon wafers can be simultaneously polished in both surfaces thereof.

This double-sided polisher has no sun gear incorporated therein, which allows a space on the carrier plate available for forming respective holding holes to be expanded by an area which otherwise would be occupied for accommodating the sun gear. As a result, in comparison with the other double-sided polisher with sun gear, this double-sided polisher (hereafter, referred to as a double-sided polisher with no sun gear) having the same size thereto can handle the silicon wafers of larger size.

However, there have been following problems in association with the method for double-sided polishing of the silicon wafers by using the double-sided polisher with no sun gear according to the prior art.

In specific, in the method of double-sided polishing of the wafer by the conventional apparatus, a direction of rotation as well as a speed of rotation of the silicon wafer within corresponding wafer holding hole has been unstable during polishing of the wafer. This is because the frictional resistance acting on the front surface of the wafer from the upper surface plate side has not been in well balance with the frictional resistance acting on the back surface of the wafer from the lower surface plate side, or the deference obtained between said frictional resistances has been limited to a small amount.

Owing to this, quite a minor defect during polishing of the wafer could suspend the rotation of the silicon wafer. Or otherwise, even in the case of not reaching to such a halt condition, if the speed of rotation and the rotating direction of the wafer are unstable as discussed above, then a variation in flatness among respective wafers within a batch should be increased. Accordingly, there has been a fear that a tapered outer periphery of the wafer and/or a polish-sagging thereof may cause unsatisfied flatness.

In the light of the conditions described above, the inventors of the present invention has devoted themselves in the research and development to find that if the difference is created in a positive manner between the frictional resistance acting on the front surface of the wafer from the upper surface plate side and the frictional resistance acting on the back surface of the wafer from the lower surface plate side, then the rotation of the wafer would not be suspended within the holding hole even in case of any defective polishing conditions induced during polishing of the wafer. It has been found also that if such difference between the frictional resistances during polishing of the wafer can be controlled to be stable, the direction of rotation and/or the speed of rotation of the silicon wafer in the wafer holding hole can be stabilized, and as a result, the polish-sagging of the outer periphery of the wafer can be suppressed and the variation in flatness among respective wafers within a batch can be reduced. The inventors have completed the present invention with the knowledge that this enables a high level of flatness of the wafer.

SUMMARY OF THE INVENTION

An object of the present invention is to provide a method for polishing a semiconductor wafer by using a double-sided polisher that can prevent a polish-sagging in an outer periphery of the wafer thus to increase a degree of flatness of the semiconductor wafer.

The present invention in a first aspect provides a method for polishing a semiconductor wafer by using a double-sided polisher, in which a semiconductor wafer is held in a wafer holding hole formed in a carrier plate, and the carrier plate is driven to make a circular motion associated with no rotation on it own axis between an upper surface plate and a lower surface plate having polishing cloths extending over opposite surfaces thereof respectively, within a plane parallel with a surface of the carrier plate in such a manner that the semiconductor wafer may be rotated in its corresponding wafer holding hole, while supplying a polishing agent to the semiconductor wafer, so that a front and a back surfaces of the semiconductor wafer can be polished simultaneously, said method further characterized in using such a double-sided polisher that can cause the semiconductor wafer to rotate at a speed of 0.1-1.0 rpm within the wafer holding hole during polishing of the wafer.

The semiconductor wafer in this context may be a silicon wafer, a gallium arsenide wafer and so on. The semiconductor wafer is not limited in size and maybe such a wafer having a large diameter, including, for example, a 300 mm wafer. The semiconductor wafer may be coated with an oxide film on either one of the surfaces. In that case, a bare wafer surface in the opposite side to the oxide film of the semiconductor wafer may be selectively polished.

The double-sided polisher is not limited to any specific ones but maybe any doubled-sided polisher with no sun gear in so far as it includes no sun gear incorporated therein and allows the carrier plate to make a motion between a pair of polishing surface plates so that the front and the back surfaces of the semiconductor wafer may be polished simultaneously.

The number of wafer holding holes formed in the carrier plate may be only one (single wafer type) or may be more. The size of the wafer holding hole may be modified arbitrarily depending on the size of the semiconductor wafer to be polished.

The motion of the carrier plate is limited within the plane parallel with the front (or the back) surface of the carrier plate and the direction of the motion thereof is defined as such a circular motion associated with no rotation on its own axis, in which the silicon wafer held between the pair of polishing surface plates may be caused to rotate within its corresponding wafer holding hole. Because of the circular motion of the carrier plate associated with no rotation on its own axis, all the points on the carrier plate can be controlled to trace the same sized small circular orbit.

The type of the polishing agent to be used it not limited. For example, an alkaline liquid containing no loose abrasive grain may be solely used. Alternatively, the polishing agent may be a slurry of this alkaline liquid containing an mount of diffused particles of colloidal silica (abrasive grains) with an averaged grain size in a range of 0.02-0.1 μm.

A quantity of the polishing agent to be supplied is not limited but may be varied depending on the size of the carrier plate. In one example, the polishing agent is supplied at a rate of 1.0-2.0 litter/min. The polishing agent may be supplied to the mirror-finished surface side of the semiconductor wafer. It is to be noted that preferably, the polishing agent should be rather supplied within an extent of the motion of the wafer.

The speed of rotation of the upper surface plate and that of the lower surface plate are not limited. For example, they may be rotated at the same speed or at different speeds. Further, the direction of the rotation is also not limited. In specific, they may be rotated in the same direction or rotated inversely to each other.

The pair of polishing members is not necessarily rotated together at the same time. This is because the present invention has employed such a configuration in which the carrier plate is driven to make a motion in a state where respective polishing members are pressed against the front and the back surfaces of the semiconductor wafer.

The pressure of the upper and/or the lower surface plates against the semiconductor wafer is not limited. For example, the pressure of 150-250 g/cm$^2$ may be used.

The polishing of the semiconductor wafer according to the double-sided polisher as defined here may be applied exclusively to the front surface of the wafer or exclusively to the back surface of the wafer, or otherwise may be applied to both of the front and the back surfaces of the wafer at the same time.

The type and material of respective polishing cloths to be provided over the upper and the lower surface plates are not limited to specific ones. For example, a hard pad of expanded urethane foam or a soft pad of non-woven fabric impregnated with urethane resin and then set therewith may be used. In addition, such a pad composed of base fabric made of non-woven fabric and urethane resin expanded on the base fabric may be used. In this case, the polishing cloths of the same type may be employed as the polishing cloths for both of the upper and the lower surface plates or the polishing cloths of different types from each other may be employed for them respectively.

The circular motion of the carrier plate associated with no rotation on its axis in this context refers to such a circular motion that the carrier plate is revolved while keeping always an eccentric condition by a predetermined distance with respect to an axis line of the upper and the lower surface plates.

The outer periphery of the wafer is apt to be tapered at the rotating speed of the semiconductor wafer less than 0.1 rpm. In contrast, at the rotating speed higher than 1.0 rpm, finished profiles of respective wafers in a batch are apt to be unstable.

Such a rotation speed higher than that used in the prior art could be obtained relatively easily by creating a large difference between the frictional resistance acting on the front surface of the wafer from the upper surface plate side and the frictional resistance acting on the back surface of the wafer from the lower surface plate side during the polishing of the wafer.

It is to be noted that a method used to crate the large difference between the frictional resistances is not limited. For example, a method of differentiating the diameter between the upper and the lower surface plates, a method of differentiating the shape of the polishing cloths from each other, or a method of differentiating the rotating speed between the upper and the lower surface plates may be employed. In addition, a method of differentiating the friction coefficient against the wafer between the upper and the lower polishing cloths may be employed.

Further, the present invention in a second aspect provides a method for polishing a semiconductor wafer by using a double-sided polisher in accordance with the first aspect, in which a frictional resistance of the polishing cloth in the upper surface plate side against the semiconductor wafer is differentiated from a frictional resistance of the polishing cloth in the lower surface plate side against the semiconductor wafer.

The present invention in a third aspect provides a method for polishing a semiconductor wafer by using a double-sided polisher in accordance with the second aspect, in which a diameter of the upper surface plate is differentiated from a diameter of the lower surface plate.

The difference in diameter between the upper and the lower surface plates is appropriately determined in dependence on the conditions, including the size of the semiconductor wafer to be polished, the total number of semiconductor wafers to be processed at one-time polishing and the like.

The present invention in a fourth aspect provides a method for polishing a semiconductor wafer by using a double-sided polisher in accordance with the second aspect, in which a shape of the polishing cloth in the upper surface plate side is differentiated from a shape of the polishing cloth in the lower surface plate side.

The shape of the polishing cloth may include a circular shape, an elliptical shape, a triangular shape, a polygonal shape, such as a rectangular shape and a shape having more sides, and other arbitrary shapes, respectively in plan view.

The present invention in a fifth aspect provides a method for polishing a semiconductor wafer by using a double-sided polisher in accordance with the second aspect, in which a rotating speed of the upper surface plate is differentiated from a rotating speed of the lower surface plate.

The present invention in a sixth aspect provides a method for polishing a semiconductor wafer by using a double-sided polisher, in which a semiconductor wafer is inserted and held in a wafer holding hole formed in a carrier plate, and the carrier plate is driven to make a motion between an upper surface plate and a lower surface plate having polishing cloths extending over opposite surfaces thereof respectively, within a plane parallel with a surface of the carrier plate while supplying a slurry containing abrasive grains to the semiconductor wafer, so that a front and a back surfaces of the semiconductor wafer can be polished simultaneously, said method further characterized in using such a double-sided polisher in which the semiconductor wafer is polished in a state where a part of the outer periphery of said semiconductor wafer is protruded by 3-15 mm beyond the polishing cloths.

The motion of the carrier plate may be any motion so far as it being within the plane parallel with the front (or the back) surface of the carrier plate and other requirements including the direction of the motion is not limited. The motion of the carrier plate may be, for example, a circular motion associated with no rotation on its own axis, in which the semiconductor wafer held between the upper and the lower surface plates may be allowed to rotate within the wafer holding hole. In addition, a circular motion centering around the centerline of the carrier plate, a circular motion at an eccentric position and also a linear motion may be used. In case of the linear motion, it is preferable that the upper and the lower surface plates are rotated around respective axis lines in order to achieve uniform polishing of the front and the back surfaces of the wafer.

The protrusion of the outer periphery of the wafer is in a range of 3-15 mm. With the protrusion smaller than 3 mm, the polish-sagging may be greater. With the protrusion greater than 15 mm, disadvantageously, ring shaped steps would be created on the surface of the wafer.

Further, the carrier plate may be made to have such a thickness that the end faces of the carrier plate in the polishing cloth sides are approximately flush with the polished surface of the semiconductor wafer in their height directions. This may reduce a degree of rebound of the polishing cloth during the polishing, so that a pressure per unit area in the outer periphery of the semiconductor wafer can be made relatively smaller as compared to that in the central region of the wafer. Consequently, this can suppress the polish-sagging in the outer periphery of the semiconductor wafer.

The type of the polishing agent (slurry) to be used it not limited. For example, such a polishing agent of an alkaline etchant having a pH value of 9-11 containing an mount of diffused particles of colloidal silica (abrasive grains) with an averaged grain size in a range of 0.1-0.02 μm may be employed. Alternatively, the polishing agent may be an acid etchant containing an amount of diffused abrasive grains. A quantity of the slurry to be supplied is not limited but may be varied depending on the size of the carrier plate. In one example, the polishing agent is supplied at a rate of 1.0-3.0 litter/min. The polishing agent may be supplied onto the surface opposite to the mirror finishing surface of the semiconductor wafer (i.e., non-polished surface) . In this case, the surface to be polished should be polished by the lower surface plate. Further, preferably the slurry supply hole may be arranged within an extent of the motion of the wafer.

The speed of rotation of the upper surface plate and that of the lower surface plate are not limited. For example, they may be rotated at the same speed or at different speeds. Further, the direction of the rotation is not limited. In specific, they may be rotated in the same direction or rotated inversely to each other. In this regard, the upper and the lower surface plates are not necessarily rotated together at the same time. This is because the present invention has employed a configuration in which the carrier plate is driven to make a motion in a state where respective polishing cloths of the upper and the lower surface plates are pressed against the front and the back surfaces of the semiconductor wafer.

The pressure of the upper and the lower surface plates to be applied against the semiconductor wafer is not limited. For example, the pressure of 150-250 g/cm$^2$ may be used.

Further, a quantity to be polished off from the front and the back surfaces of the wafer and a polishing rate to be applied thereto are also not limited. It is to be noted that a difference in the polishing rate between the front surface and the back surface of the wafer may have a great influence on the glossiness of the front and the back surfaces of the wafer. Known measuring instrument (e.g., a gloss meter available from Nippon Denshoku Inc.) may be used to measure the glossiness.

The type and material of respective polishing cloths to be extended over the upper and the lower surface plates are not limited. For example, a hard pad of expanded urethane foam or a pad of non-woven fabric impregnated with urethane resin and then set therewith may be used. In addition, such a pad composed of base fabric made of non-woven fabric and urethane resin expanded on the base fabric may be used. It is to be appreciated that one polishing cloth different from the other polishing cloth in a sink rate of the semiconductor wafer during polishing may be used for one of the upper and the lower surface plates while using the other polishing cloth for the other of the surface plates so as to differentiate the glossiness between the front surface and the back surface of the semiconductor wafer.

Further, the present invention in a seventh aspect provides a method for polishing a semiconductor wafer by using a double-sided polisher in accordance with the sixth aspect, in which the motion of the carrier plate is a circular motion associated with no rotation on its own axis.

The circular motion of the carrier plate associated with no rotation on its axis in this context refers to such a circular motion that the carrier plate is revolved while keeping always an eccentric condition by a predetermined distance with respect to an axis line of the upper and the lower surface plates. Because of the circular motion of the carrier plate associated with no rotation on its own axis, all the points on the carrier plate can be controlled to trace the same sized small circular orbit.

Further, the present invention in an eight aspect provides a method for polishing a semiconductor wafer by using a double-sided polisher in accordance with the sixth or seventh aspect, in which the semiconductor wafer has only one mirror-finished surface and the polishing agent is supplied from an opposite side of said mirror-finished surface of the semiconductor wafer. In specific, the semiconductor wafer in this aspect is representative of a one-side satin-finished wafer having the satin-finished back surface.

The method for supplying the polishing agent (slurry) from the opposite side of the mirror-finished surface of the semiconductor wafer is not limited. For example, if the surface to which the slurry is to be supplied is the upper surface of the semiconductor wafer, then the slurry may be supplied by a gravity-drop method by means of a slurry supply nozzle. In this case, a through-hole maybe formed in the carrier plate so that the slurry may drops to the lower surface plate side therethrough.

The present invention in a ninth aspect provides a method for polishing a semiconductor wafer by using a double-sided polisher in accordance with any one of the sixth through eight aspects, in which the polishing agent is supplied from a supply hole located on an orbit of the motion of the semiconductor wafer held in the carrier plate.

Further, the present invention in a tenth aspect provides a method for polishing a semiconductor wafer by using a double-sided polisher in accordance with any one of the sixth through ninth aspects, in which the semiconductor wafer is coated with an oxide film on either one of the surfaces thereof.

The type of the oxide film is not limited. The oxide film includes, for example, a silicon oxide film used in the silicon wafer. The thickness of the oxide film is also not limited. The wafer surface coated with this oxide film may be polished to form a satin-finished surface or may not be polished thus to remain as a non-polished surface.

According to the present invention in the first through fifth aspects, the carrier plate is driven to make a motion within the plane parallel with the surface of the carrier plate between the fixed abrasive member and the polishing cloth while supplying the polishing agent to the semiconductor wafer. This enables both the front and the back surfaces of the wafer to be polished with the aid of these fixed abrasive member and the polishing cloth.

At that time, a difference is created in a positive manner during polishing between the frictional resistance acting on the front surface of the wafer from the upper surface plate side and the frictional resistance acting on the back surface of the wafer from the lower surface plate side by some way. Accordingly, this ensures that the semiconductor wafer is rotated within the wafer holding hole during polishing of the wafer in a steady manner. Thereby, there will be no more fear that the rotation of the wafer would be suspended in the wafer holding hole even if some defective conditions of the polishing arise during the polishing of the wafer. Further, the polishing process obtained by such sure and steady rotation of the wafer may reduce the trend of uneven polishing observed particular to part from part in the outer periphery of the wafer. By way of this, the present invention can suppress the polish-sagging in the outer periphery of the wafer, thereby achieving the high degree of flatness of the wafer.

To create the difference in the positive manner between the frictional resistances acting on the front and the back surfaces of the wafer from the upper and the lower surface plates respectively, the following methods may be applicable. According to one method by way of example, the semiconductor may be polished between the upper and the lower surface plates having different diameters from each other, or in another method, the semiconductor wafer may be polished between the polishing cloths having different shapes from each other, or in yet another method, the rotating speed may be differentiated between the upper and the lower surface plates thus to polish the semiconductor wafer.

According to the present invention in the sixth through tenth aspects, the carrier plate is driven to make a motion within the plane parallel with the surface of the carrier plate between the upper surface plate and the lower surface plate while supplying the polishing agent to the semiconductor wafer. This enables both the front and the back surfaces of the semiconductor wafer (in some cases, either of the surfaces) to be polished.

During this process, the semiconductor wafer is rotated with a part of the outer periphery thereof protruded beyond the polishing cloths thus to polish the surface to be polished. During polishing, the outer periphery of the wafer is polished while passing through the non-polishing region each time when the wafer is rotated by a predetermined angle. Accordingly, the contact area to the polishing cloth per unit time of the outer periphery of the wafer is reduced as compared to the central area of the wafer. Consequently, this suppresses the polish-sagging in the outer periphery of the wafer thus to increase the degree of flatness of the wafer.

Especially, according to the present invention in the seventh aspect, the semiconductor wafer is held between the upper surface plate and the lower surface plate, and while keeping this state, the carrier plate is driven to make a circular motion associated with no rotation on its own axis so as to polish the surface of the wafer. Because of the circular motion of the carrier plate associated with no rotation on its own axis, every point on the carrier plate follows the same motion. This could be called as a kind of reciprocating motion. Specifically, it could also be considered that the orbit of the reciprocating motion traces a circle. Due to such a motion of the carrier plate, the wafer can be polished while rotating in the wafer holding hole during being polished. By way of this, the uniform polishing can be accomplished over approximately entire region on the polished surface of the wafer and thereby the polish-sagging in the outer periphery of the wafer can be further reduced.

Yet further, according to the present invention in the eigth aspect, upon polishing of the wafer, the semiconductor wafer is polished while the polishing agent being supplied from the opposite surface side of the mirror-finished surface of the semiconductor wafer. It is to be appreciated that if those slurry supply holes are formed in locations on the orbit of the motion of the semiconductor wafer, it can be ensured that the polishing agent is supplied to the semiconductor wafer.

Still further, according to the present invention in the tenth aspect, either one of the surfaces of the semiconductor wafer is coated with the oxide film. The other surface opposite to this surface of the oxide film can be polished with a predetermined level.

PREFERRED EMBODIMENTS FOR IMPLEMENTING THE PRESENT INVENTION

Preferred embodiments of the present invention will now be described with reference to the attached drawings. FIGS. 1 through 8 are provided to illustrate a first embodiment according to the present invention. The first embodiment will be described by taking as an example a polishing of a silicon wafer with its front surface formed into a mirror-finished surface and its back surface formed into a satin-finished surface.

Figure 1:
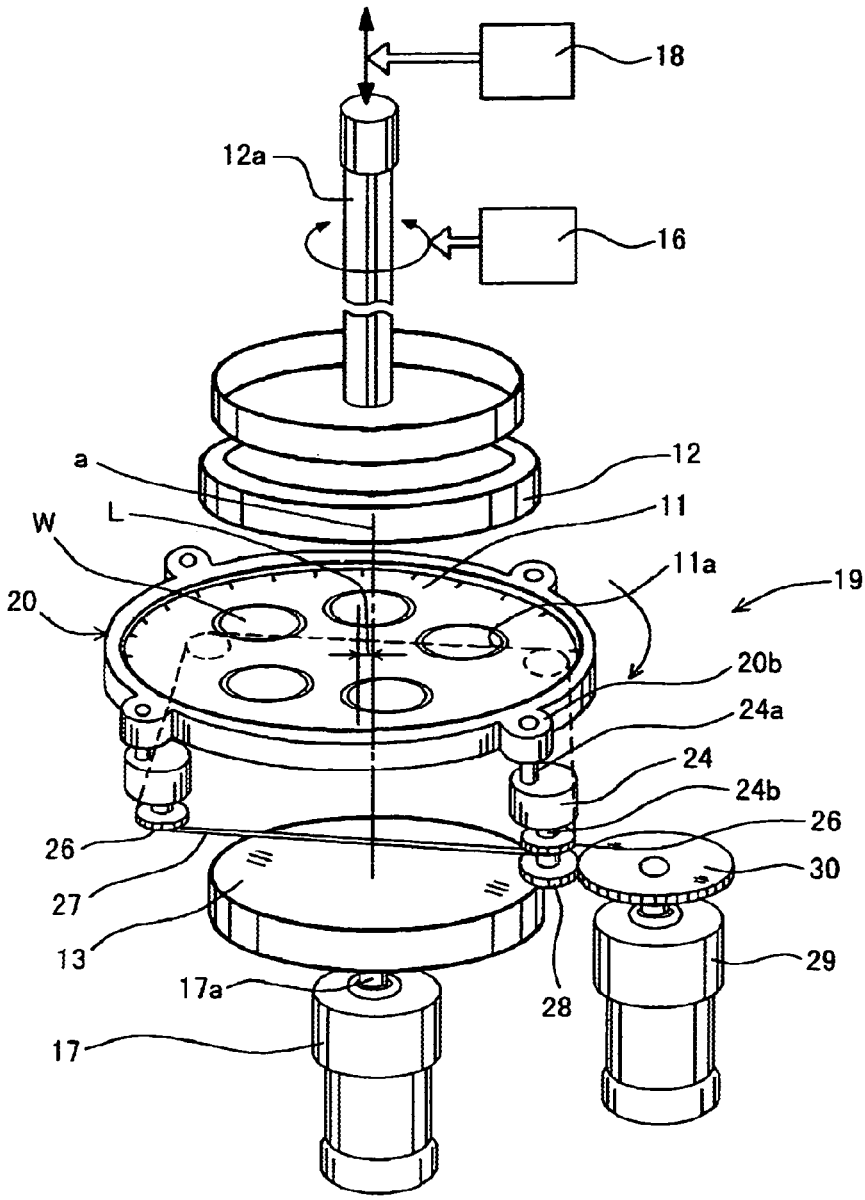
Fig. 1 PRIOR ART
FIG. 1 is a perspective view illustrating a general configuration of a double-sided polisher according to a first embodiment of the present invention.
Figure 2:
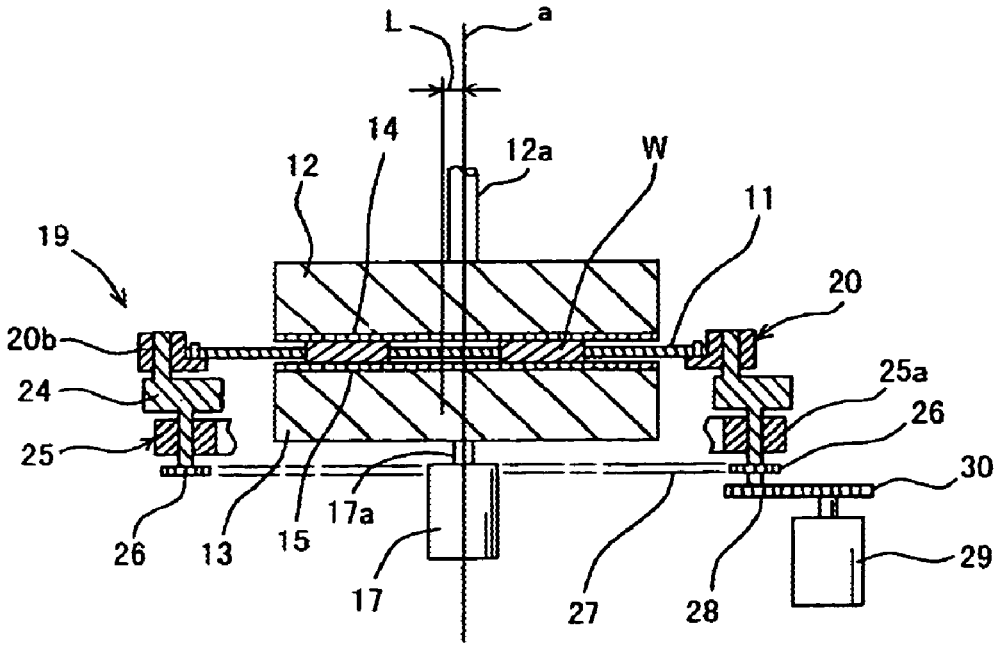
Fig. 2 PRIOR ART
FIG. 2 is a longitudinal sectional view illustrating a double-sided polishing process in a method of polishing a semiconductor wafer by using the double-sided polisher according to the first embodiment of the present invention.
Figure 2:
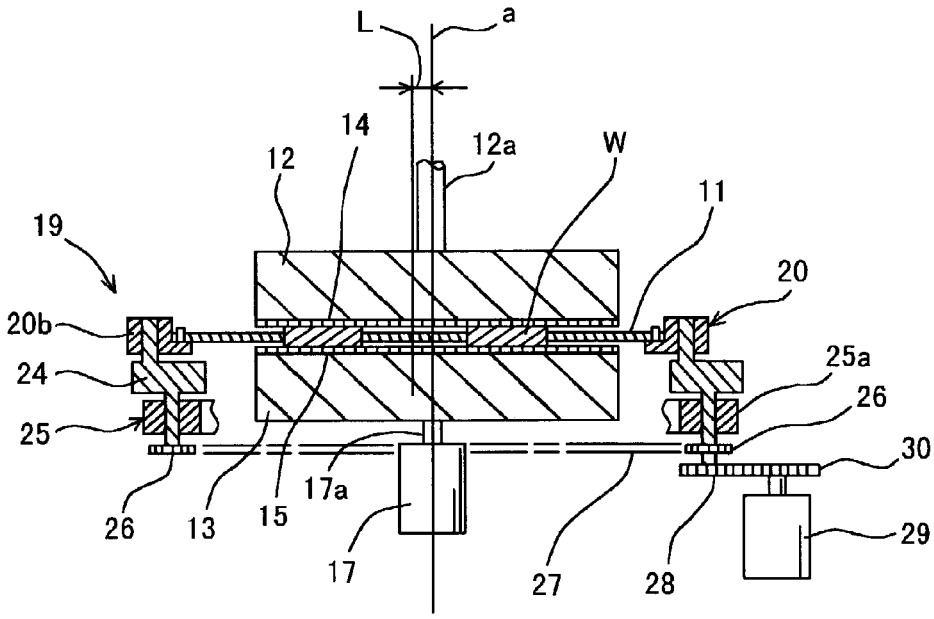

In FIG. 1 and FIG. 2, reference numeral 10 generally designates a double-sided polisher to which is applied a method of polishing the semiconductor wafer according to the first embodiment of the present invention (hereafter, simply referred to as a double-sided polisher). This double-sided polisher 10 comprises a carrier plate 11 made of epoxy-glass having a circular disc-like shape in plan view in which five of wafer holding holes 11*a* have been formed by every 72 degrees (in the circumferential direction) around an axis line of the plate so as to penetrate through the plate, and a pair of upper surface plate 12 and lower surface plate 13 functioning for clamping silicon wafers "W", each having a diameter of 300 mm and having inserted and thus held operatively in the wafer holding hole 11*a* so as to be free to rotate therein, from above and below sides with respect to the wafers W and also functioning for polishing the surfaces of the wafers W by moving themselves relatively with respect to the silicon wafers W. Such a silicon wafer having either one of the surfaces coated with an oxide film may be employed. Further, a thickness of the carrier plate 11 (600 μm) is made to be a little thinner than that of the silicon wafer W (730 μm).

A hard pad of expanded urethane foam 14 is extended over an under surface of the upper surface plate 12 for polishing the back surface of the wafer to form it into a satin-finished surface.

On the other hand, a soft non-woven fabric pad 15 made of non-woven fabric impregnated with urethane resin and then set therewith is extended over a top surface of the lower surface plate 13 for polishing the front surface of the wafer to form it into a mirror-finished surface. The hard expanded urethane foam pad 14 (MHS15A manufactured by Rodale Inc.) has a hardness of 85° (measured by Asker hardness meter), a density of 0.53 g/cm$^3$, a compressibility of 3.0% and a thickness of 1000 μm. On one hand, the soft non-woven fabric pad 15 (Suba600 manufactured by Rodale Inc.) has a hardness of 80° (measured by Asker hardness meter), a compressibility of 3.5%, an elastic modulus in compression of 75% and a thickness of 1270 μm.

As shown in FIG. 1 and FIG. 2, the upper surface plate 12 is driven to rotate within a horizontal plane by an upper rotary motor 16 via a rotary shaft 12*a* extending upwardly.

Further, the upper surface plate 12 is moved up or down in a vertical direction by a lifting device 18 which advances or retracts it along its axial direction. This lifting device 18 is used when the silicon wafer W is to be supplied or removed to/from the carrier plate 11. It is to be appreciated that pushing pressures of the upper surface plate 12 and the lower surface plate 13 applied onto the front and the back surfaces of the silicon wafer W may be generated by pressurizing means by way of, for example, air bag system incorporated in the upper and the lower surface plates 12 and 13, though not shown.

The lower surface plate 13 is driven to rotate within a horizontal plane by a lower rotary motor 17 via its output shaft 17*a*. The carrier plate 11 is driven to make a circular motion within a plane parallel with the surface of the plate 11 (i.e., horizontal plane) by a carrier circular motion mechanism 19 in such a manner that the plate 11 may not make the rotation on its own axis.

The carrier circular motion mechanism 19 will now be described in detail with reference to FIG. 1, FIG. 2, FIG. 4 and FIGS. 5 through 7, respectively.

As shown in those drawings, the carrier circular motion mechanism 19 has an annular carrier holder 20, which secures the carrier plate 11 from the outer side thereof. Those members 11 and 20 are coupled to each other via a coupling structure 21. The coupling structure in this context refers to a means for coupling the carrier plate 11 to the carrier holder 20 in such a manner that the carrier plate 11 is not allowed to make a rotation on its own axis and also the elongation of the plate 11 due to thermal expansion should be absorbed.

Specifically, the coupling structure 21 includes a plurality of pins 23 arranged so as to project from an inner peripheral flange 20*a* of the carrier holder 20 by every predetermined angle along the circumference of the holder, and a plurality of elongated pin holes 11*b* with the number equivalent to said pins 23, which have been punched through the outer peripheral portion of the carrier plate 11 in the locations corresponding to said pins 23 for receiving corresponding pins 23 respectively.

Each of those pin holes 11*b* is formed so as for a longitudinal direction thereof to match up with a radial direction of the plate so that the carrier plate 11 coupled with the carrier holder 20 via those pins 23 is allowed to move in its radial direction by a small distance. In this configuration in which the carrier plate 11 is engaged with the carrier holder 20 by inserting the pins 23 into the pin holes 11*b* with some play left between them, the elongation of the carrier plate 11 caused by the thermal expansion during the double-sided polishing can be absorbed. It is to be noted that root portion of each pin 23 is screwed into a threaded hole formed in said inner peripheral flange 20*a* by way of an external thread formed on an outer surface of the root portion. Further, in a location immediately above the external thread section of each pin 23, a flange 23*a* is formed surrounding the pin 23 for loading the carrier plate 11 on said flange 23*a*. Therefore, by adjusting the length of screwing of the pin 23 into the threaded hole, the level of height of the carrier plate 11 loaded on the flange 23*a* can be adjusted.

This carrier holder 20 includes four bearing sections 20*b* projecting outward by every 90 degrees along the outer periphery of the carrier holder 20. an eccentric shaft 24*a* projecting from an eccentric location on a top surface of a disc shaped eccentric arm 24 having a small diameter is inserted into each of the bearing sections 20*b*. A rotary shaft 24*b* extends down from a central portion on an under surface of each of those four eccentric arms 24. Those rotary shafts 24*b* are respectively inserted through the total of four bearing sections 25*a* arranged by every 90 degrees in an annular base 25 of the apparatus, with top end portions of respective rotary shafts 24*b* projected beyond corresponding bearing sections 25*a*. Sprockets 26 are fixedly attached to the downwardly projected top end portions of the rotary shafts 24*b*, respectively. An endless timing chain 27 is installed so as to connect respective sprockets 26 within a horizontal plane. It is to be appreciated that this timing chain 27 may be replaced with a driving force transmission system composed of gear train. Those four sprockets 26 together with the timing chain 27 construct a synchronizing means for rotating all of those four rotary shafts 24*b* in the same timing so that those eccentric arms 24 are synchronous to one another to make circular motions.

Further, one of those four rotary shafts 24*b* is formed to be longer than others, so that the top end portion of this longer rotary shaft 24*b* is protruded downwardly beyond the sprocket 26. A gear 28 for transmitting the driving force is fixedly attached to that protruded portion of the rotary shaft 24*b*. This gear 28 is engaged with a driving gear 30 having a larger diameter and fixedly attached to an output shaft extending upward from a motor 29 for making a circular motion represented by a geared motor, for example. It is to be noted that the timing chain 27 may not be necessarily used for synchronizing the four eccentric arms 24 but, for example, the four eccentric arms 24 may be respectively provided with said motors 29 for circular motions, allowing each of four eccentric arms 24 to be rotated individually. In that case, it is a matter of course that the respective motors 29 must be controlled to make synchronous rotation to one another.

According to the mechanism described above, as the output shaft of the motor for the circular motion 29 is rotated, the turning force generated thereby is transmitted to the timing chain 27 via the gears 30, 28 and the sprocket 26 fixedly attached to the long rotary shaft 24*b*, and then the timing chain 27 is driven to run along a course supported by four sprockets 26, and finally all the four eccentric arms 24 are driven by respective sprockets 26 to synchronously rotate around respective rotary shafts 24*b* within the horizontal plane. By way of this, the carrier holder 20 operatively coupled with an assembly consisting of respective eccentric shafts 24*a* and thus the carrier plate 11 held by the holder 20 can make the circular motion associated with no rotation on their own axes, within the horizontal plane parallel with the plate 11. That is, the carrier plate 11 is revolved around an axis line "a" of the upper and the lower surface plates 12 and 13 while being held in an eccentric position therefrom by a distance "L". This distance L is equivalent to the distance between the eccentric shaft 24*a* and the rotary shaft 24*b*. Owing to this circular motion of the carrier plate 11 associated with no rotation on its own axis, every point on the carrier plate 11 may follow the orbit tracing the same sized small circle.

Figure 6:
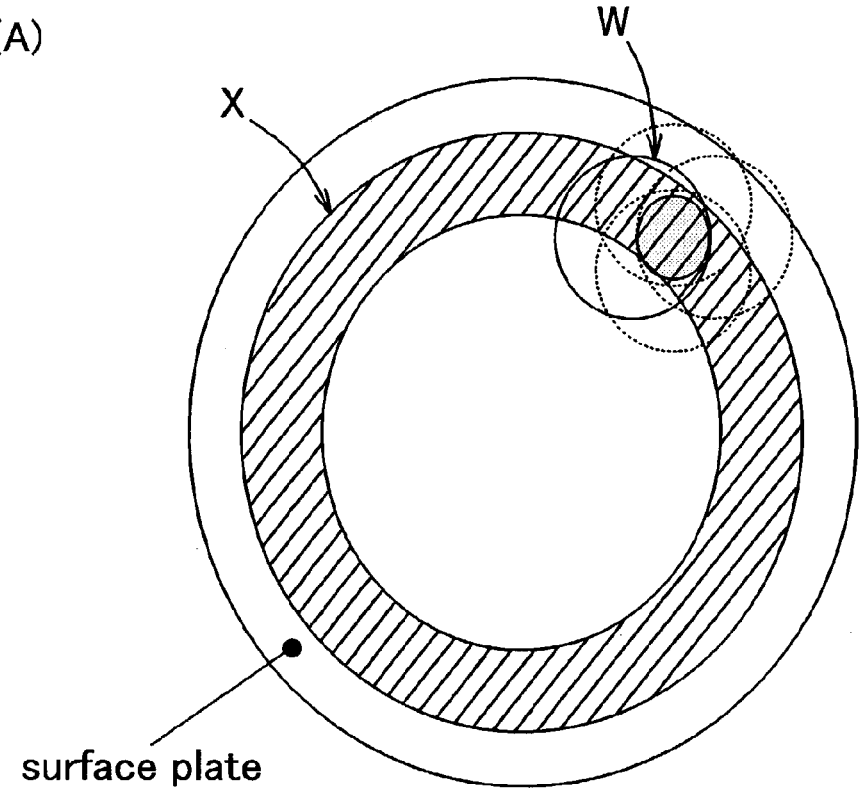
FIG. 6 is a plan view illustrating an orbit of a motion of the semiconductor wafer during being polished and a location of a polishing agent supply hole.
Figure 6:
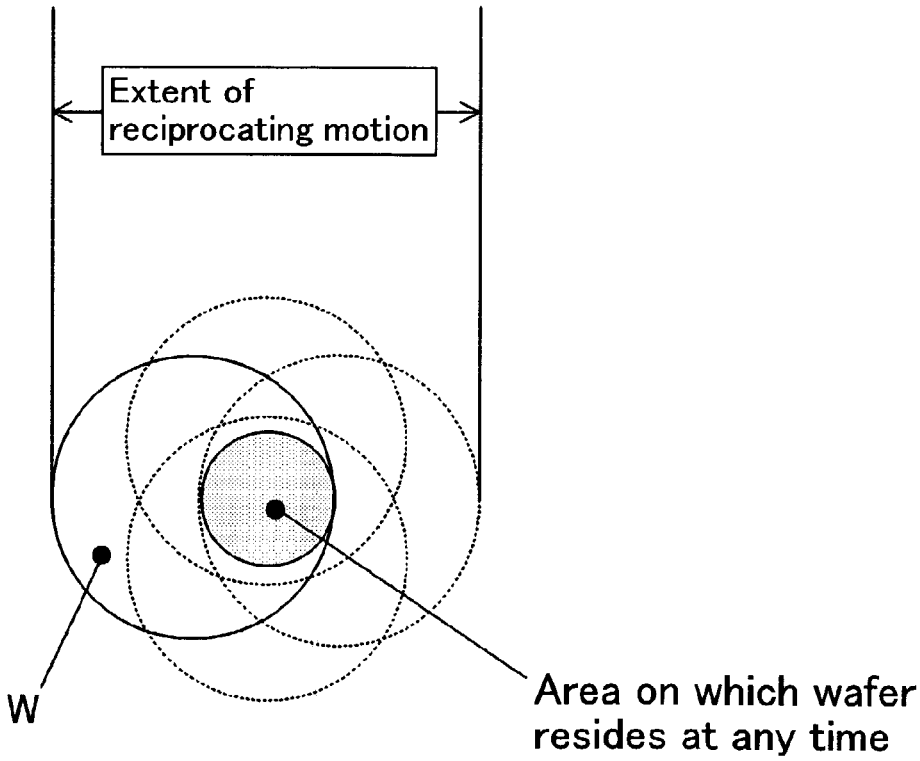

Further, FIG. 6 shows a location of a slurry supply hole in this apparatus. For example, a plurality of slurry supply holes formed in the upper surface plate 12 are located in an annular region "X" having a predetermined width on which the silicon wafer W resides at any time. This configuration allows the slurry to be supplied to the back surface of the silicon wafer W at any time even when the silicon wafer W is moved in a reciprocating manner. As a result, the thin film formed by the slurry can be always maintained over the back surface of the silicon wafer W during polishing.

Figure 7:
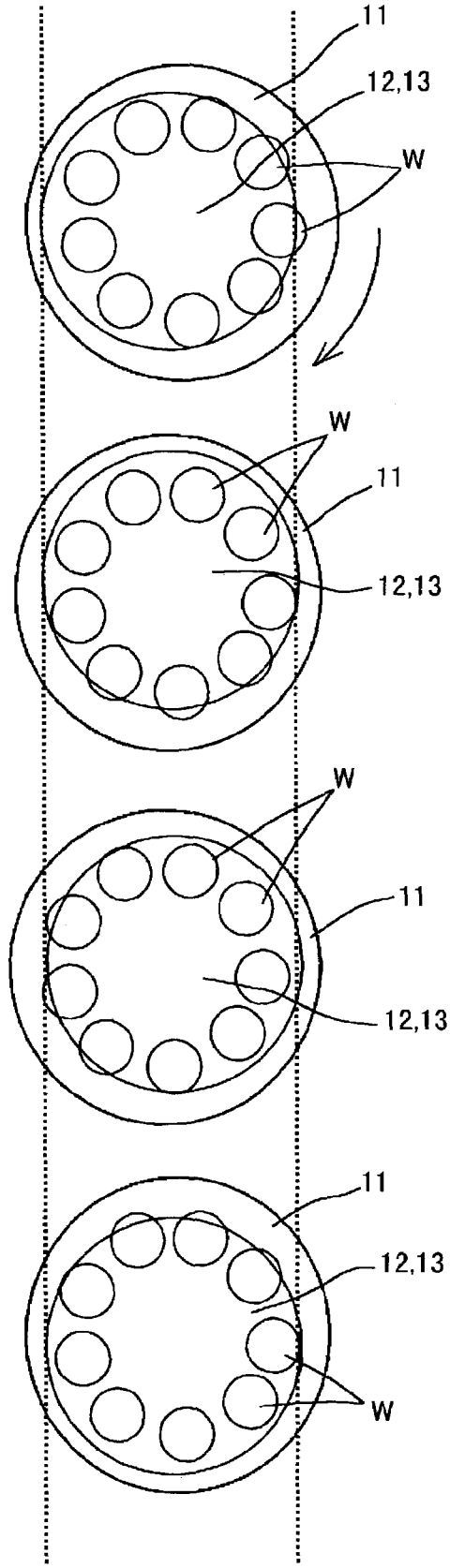
FIG. 7 is a plan view illustrating a polishing process in which a part of the outer periphery of the semiconductor wafer is protruded beyond the polishing cloth according to the first embodiment of the present invention.

Further, as shown in FIG. 6 and FIG. 7, according to this configuration, each of the silicon wafers W held in the carrier plate 11, during the circular motion of the carrier plate 11 associated with no rotation on its own axis, is polished in such a manner that a part of the outer periphery of each silicon wafer is protruded beyond the outer boundaries of the upper surface plate 12 and the lower surface plate 13 every time when each of the silicon wafers W is rotationally moved by a predetermined angle. In specific, since the outer peripheral portion of each silicon wafer W is polished while passing through non-polishing region intermittently, therefore the quantity to be polished off from this portion can be suppressed. Accordingly, this may also help improve the degree of flatness (e.g., TTV) of each silicon wafer W.

Then, a method of polishing the silicon wafer W by using this double-sided polisher 10 will be described.

At first, as shown in FIG. 1 and FIG. 2, the silicon wafers W are inserted in respective wafer holding holes 11*a* of the carrier plate 11 in the lower surface plate 13 side so as to be free to rotate therein. At that time, each of the silicon wafers W is placed with its back surface facing up. Secondly, in this state, the upper surface plate 12 is pressed against the carrier plate 11 at a pressure level of 200 g/cm$^2$.

Then, with the both pads 14, 15 being pressed against the front and the back surfaces of the wafer W, the timing chain 27 is driven to run along its course by the circular motion motor 29, while supplying the slurry from the upper surface plate 12 side. This causes all of the eccentric arms 24 to rotate synchronously within the horizontal plane, so that the carrier holder 20 held by the assembly of the eccentric shafts 24*a* and thus the carrier plate 11 make the circular motion associated with no rotation on their own axes at a speed of 24 rpm within the horizontal plane parallel with the surface of this carrier plate 11.

Figure 3:
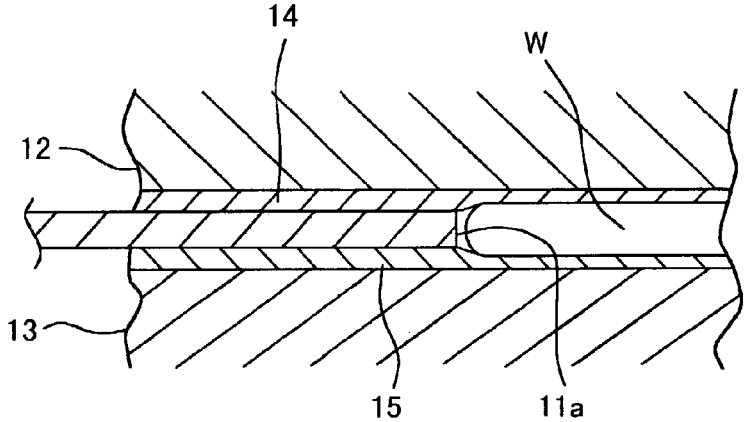
FIG. 3 is a sectional view illustrating a polishing process in the method of polishing a semiconductor wafer according to the first embodiment of the present invention.
Figure 4:
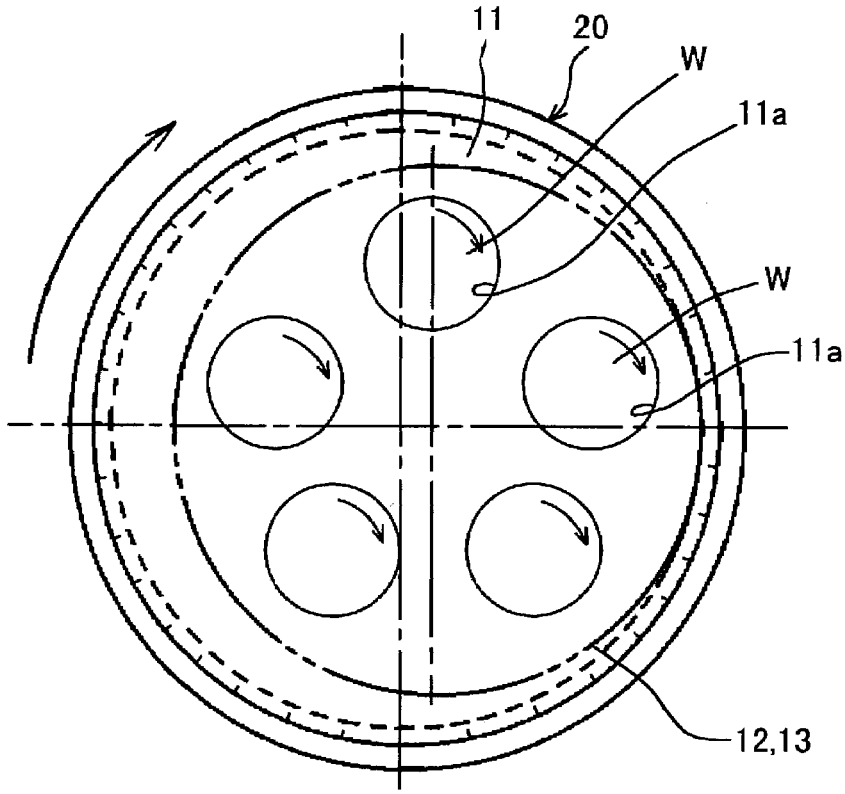
FIG. 4 is a schematic plan view of the double-sided polisher according to the first embodiment of the present invention.
Figure 5:
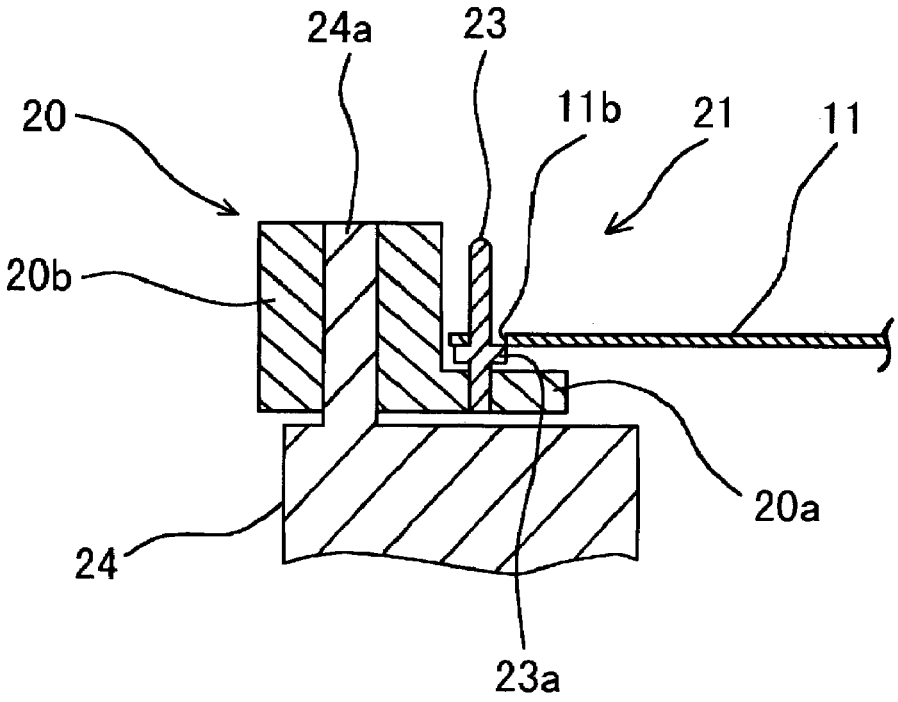
FIG. 5 is an enlarged sectional view of a main part of a driving force transmission system for transmitting a driving force to a carrier plate according to the first embodiment of the present invention.
Figure 8:
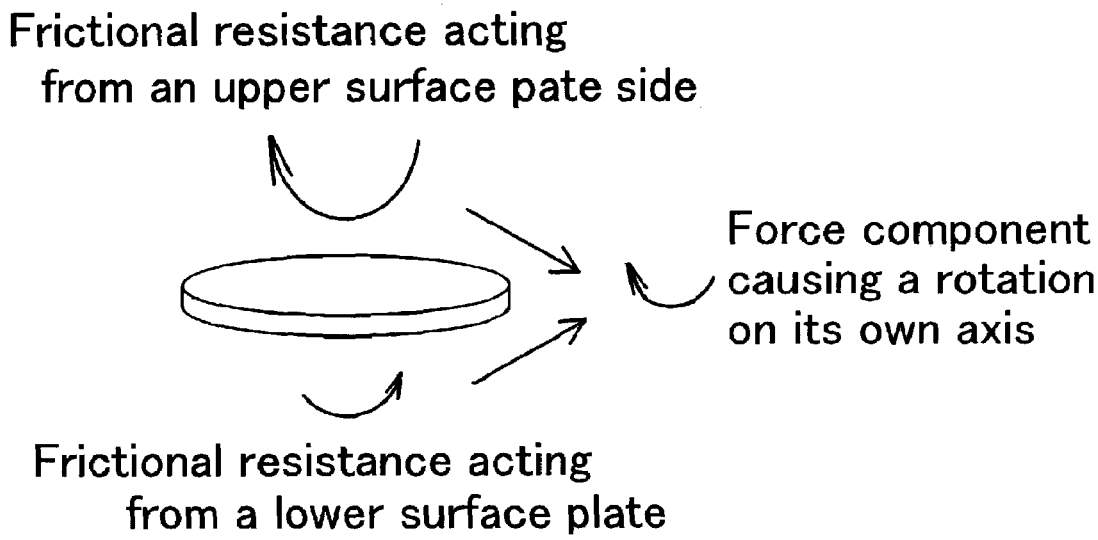
FIG. 8 is a perspective view illustrating a principle of rotation of the semiconductor wafer in a wafer holding hole according to the first embodiment of the present invention.

At that time, as shown in FIG. 3, respective silicon wafers W rotate in conjunction with the circular motion of the carrier plate 11 associated with no rotation on its own axis in a state where the silicon wafers W are sandwiched between the hard expanded urethane foam pad 14 having a lower frictional resistance and the soft non-woven fabric pad 15 having a higher frictional resistance. In this state, as shown in FIG. 8, the hard expanded urethane foam pad 14 located in the upper surface pate 12 side has the lower frictional resistance acting on the silicon wafer W, while the soft non-woven fabric pad 15 located in the lower surface plate 13 side has the higher frictional resistance acting on the silicon wafer W. In addition, both of the upper and the lower surface plates are not rotated. Consequently, a difference between the frictional resistances acting on the front surface and the back surface of the wafer can be obtained in the positive manner. Accordingly, the silicon wafer W can be polished in respective front and back surfaces, while rotating in a sure and steady manner within the horizontal plane at the speed of 0.1-1.0 rpm.

Thereby, even if defective conditions are somewhat induced during polishing of the wafer, the rotation of the silicon wafer W in the wafer holding hole 11*a* would never be suspended. Further, the polishing by way of such sure and steady rotation can suppress any deviation in polishing volume particular to part by part in the outer periphery of the wafer. Therefore, the method according to the present invention can further suppress the polish-sagging in the outer periphery of the wafer and thus improve the degree of flatness of the wafer to a higher level as compared to the prior art.

It is to be noted that the slurry used in this embodiment is an alkaline etchant of pH 10.6 containing an amount of diffused abrasive grains of colloidal silica with a grain size of 0.05 μm.

Further, in this embodiment, both of the front and the back surfaces of the wafer are polished by driving the carrier plate 11 to make a circular motion associated with no rotation on its own axis during polishing of the wafer. Since such a special motion of the carrier plate 11 has been employed to polish the wafer in both surfaces, almost entire area in both of the front and the back surfaces of the wafer can be polished in an approximately uniform manner.

Still further, since in the configuration of the apparatus according to the present invention, the materials of respective polishing cloths (pads) 14, 15 are differentiated from each other so as to make a greater difference between the frictional resistances acting on the front and the back surfaces of the wafers, therefore the polish-sagging in the outer periphery of the wafer can be prevented in a simple manner as well as with a lower cost, thereby increasing the degree of flatness of the silicon wafer W to the higher degree as compared to the prior art.

It is to be noted that the double-sided polisher 10 according to the first embodiment enables the double-sided polishing of each silicon wafer W simply by rotating the upper surface plate 12 at a speed of 25 rpm by the upper rotary motor 16, while rotating the lower surface plate 13 at 30 rpm by the lower rotary motor 17, yet without driving the carrier plate 11 to make any circular motion.

In this case, since respective silicon wafers W have been inserted and held in the wafer holding holes 11*a* so as to be free to rotate therein, therefore during polishing, respective wafers W are rotated (on their own axes) in the same direction as of the rotation of either one of the surface plates having a higher rotating speed.

Further, the upper surface plate 12 and the lower surface plate 13 may be rotated at the same rotating speed thus to produce such a silicon wafer having its front surface representative of the mirror-finished surface and its back surface representative of the satin-finished surface. In this case, if a greater difference is created between the frictional resistances of the upper and the lower polishing cloths 14, 15, then in a relatively shorter time period, the silicon wafer having the mirror-finished front surface and the satin-finished back surface can be obtained.

Alternatively, the upper surface plate 12 and the lower surface plate 13 may be rotated while allowing the carrier plate 11 to make a circular motion so as to carry out the double-sided polishing of the silicon wafer W. In this case, preferably the rotating speeds of the upper and the lower surface plates 12 and 13 are rather slowed down within a range in which uneven polishing would not be induced in both of the front and the back surfaces of the wafer. With this arrangement, both of the front and the back surfaces of the silicon wafer W can be polished uniformly over the entire area of respective surfaces. It is to be considered preferable that rotating the upper surface plate 12 and the lower surface plate 13 can provide new contact faces of the surface plates with the silicon wafer W at any time, so that the slurry can be supplied to the entire surfaces of the silicon wafer W uniformly.

Figure 9:
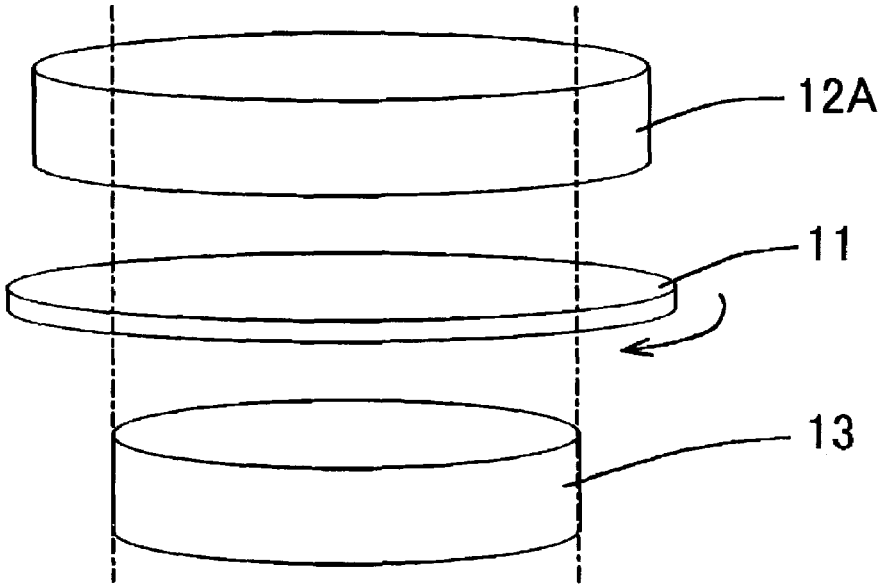
FIG. 9 is a perspective view of a main part of a double-sided polisher according to a second embodiment of the present invention.

Referring now to FIG. 9, a method of polishing semiconductor wafers by using a double-sided polisher according to a second embodiment of the present invention will be described.

As shown in FIG. 9, this embodiment is representative of an example which has employed, instead of an upper surface plate 12 in the first embodiment, a surface plate 12A having a larger diameter than the lower surface plate 13.

This method also can create a difference between the frictional resistance acting on the front surface of the silicon wafer W from the upper surface plate 12A side and the frictional resistance acting on the back surface of the silicon wafer W from the lower surface plate 13 side in more positive manner as compared to the prior art. Consequently, the rotations of the silicon wafers W in respective wafer holding holes may be generated in a sure and steady manner.

Other description on configuration, operation and effect of this embodiment is almost same as in the first embodiment, which is herein accordingly omitted.

Figure 10:
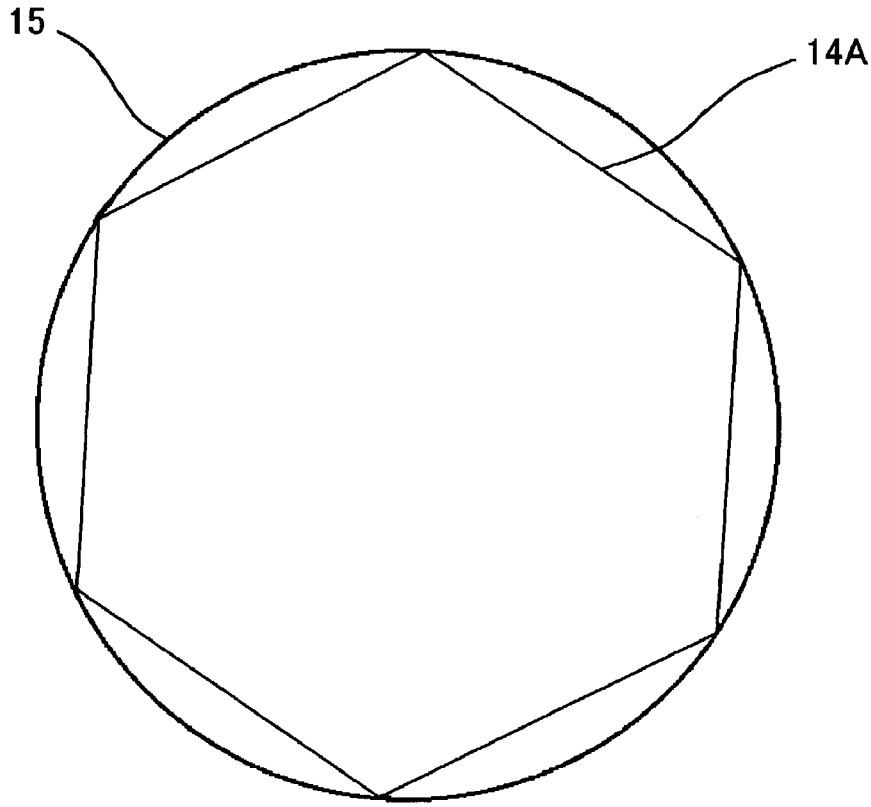
FIG. 10 is a plan view of a main part of a double-sided polisher according to a third embodiment of the present invention.

Referring now to FIG. 10, a method of polishing semiconductor wafers by using a double-sided polisher according to a third embodiment of the present invention will be described.

As shown in FIG. 10, this third embodiment is representative of an example which has employed, instead of the hard expanded urethane foam pad 14 having a circular shape in plan view extended over the upper surface plate 12 in the first embodiment, a hard expanded urethane foam pad 14A having a hexagonal shape in plan view.

In specific, since having a hexagonal shape, the polishing cloth 14 can create a difference in the frictional resistance in a positive manner with respect to the circular soft non-woven fabric pad on the lower surface plate 13. Consequently, during polishing of the wafers, the difference can be created more steadily as compared with the case of the prior art between the frictional resistance acting on the front surface of the wafer from the upper surface plate 12 side and the frictional resistance acting on the back surface of the wafer from the lower surface plate 13 side.

Other description on configuration, operation and effect of this embodiment is approximately same as in the first embodiment, which is herein accordingly omitted.

According to the invention described above, since the semiconductor wafer is rotated in the wafer holding hole during polishing of the wafers, the polish-sagging can be suppressed thus to improve the degree of flatness of the wafer.

Figure 11:
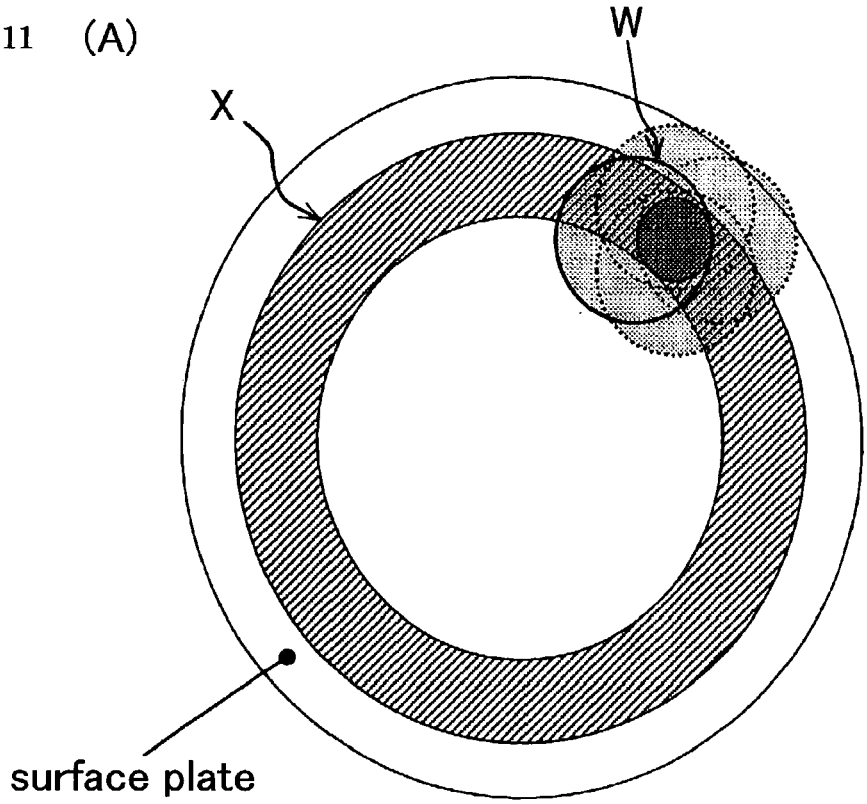
FIG. 11 is a plan view illustrating an orbit of a motion of a semiconductor wafer during being polished and a location of a slurry supply hole according to a fourth embodiment of the present invention.
Figure 11:
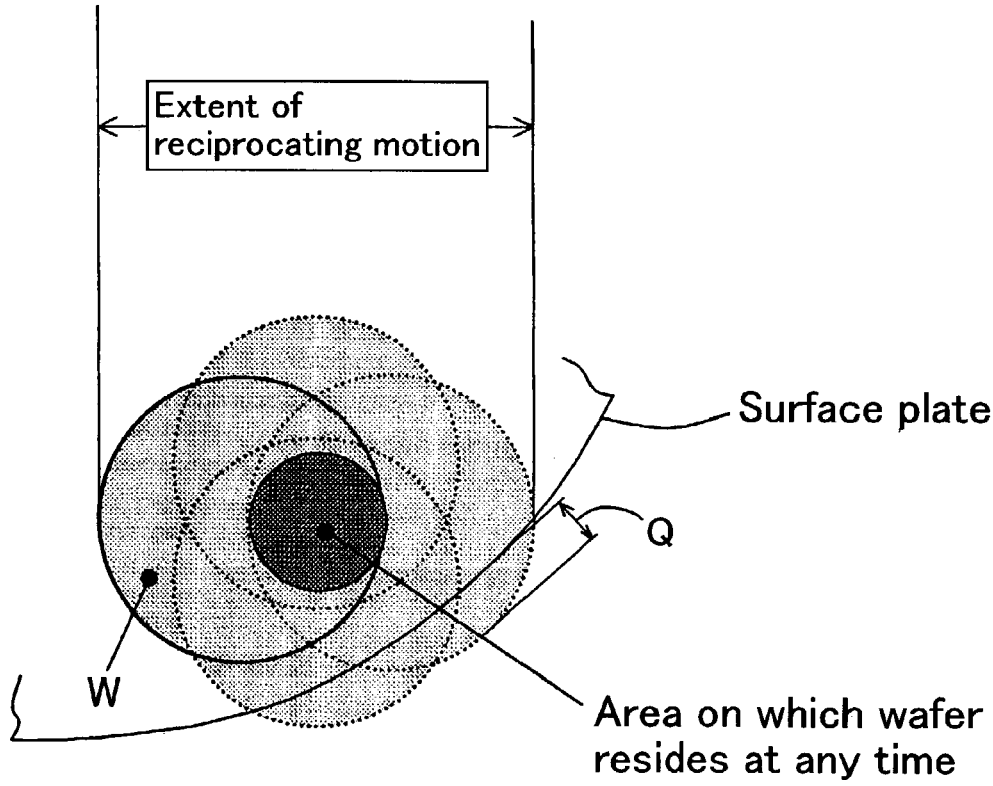
Figure 12:
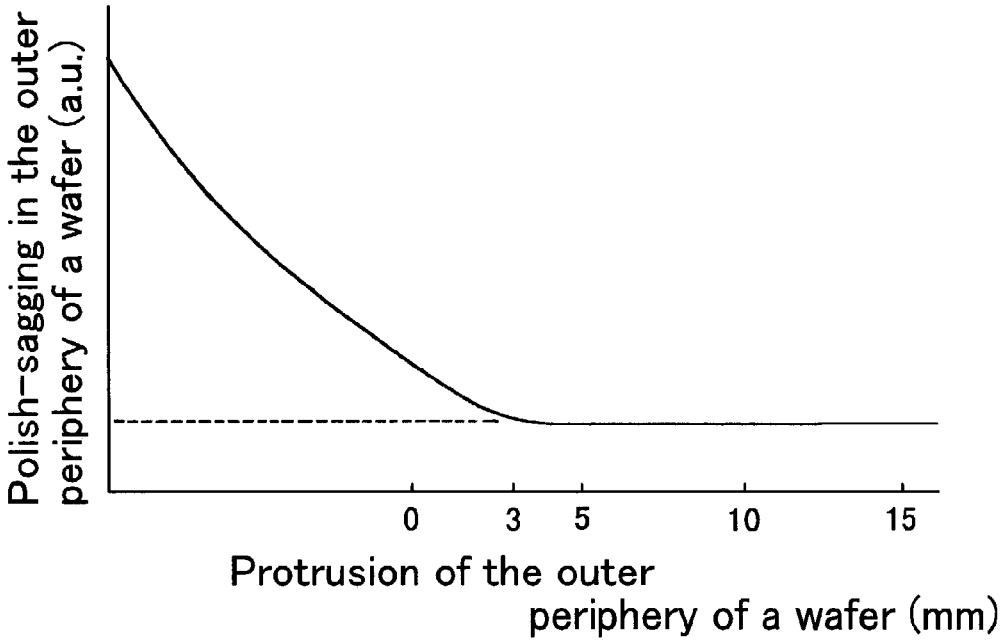
FIG. 12 is a graph illustrating a polish-sagging in an outer periphery of the semiconductor wafer as a function of a length of protrusion of the outer periphery of the wafer during polishing of the semiconductor wafer by using the double-sided polisher according to the fourth embodiment of the present invention.

Referring now to FIG. 11 and FIG. 12, a method of double-sided polishing of silicon wafers W according to a fourth embodiment in which a double-sided polisher 10 shown FIG. 1 and the like is used will be described.

At first, silicon wafers W are inserted in respective wafer holding holes 11*a* of the carrier plate 11 so as to be free to rotate therein. At that time, the respective wafers are placed in position with back surfaces thereof facing up. Then, in this state, the soft non-woven fabric pad 14 is pressed against the back surfaces of respective wafers at a pressure level of 200 g/cm$^2$, while the soft non-woven fabric pad 15 is pressed against the front surfaces of respective wafers at a pressure level of 200 g/cm$^2$.

After that, while pressing those two pads 14, 15 against the front and the back surfaces of the wafers respectively, the timing chain 27 is driven to run along its course by the circular motion motor 29 with the slurry being supplied from the upper surface plate 12 side. This causes those four eccentric arms 24 to rotate synchronously in the horizontal plane, so that the carrier holder 20 carried by the assembly of respective eccentric shafts 24*a* and thus the carrier plate 11 are driven to make a circular motion associated with no rotation on their axes at a speed of 24 rpm within the horizontal plane parallel with the surface of this plate 11. As a result, the double-sided polishing is carried out on both of front and back surfaces of the wafer respectively while the silicon wafer W is being rotated within corresponding wafer holding holes 11*a* in the horizontal plane. It is to be noted that the slurry used in this embodiment is an alkaline etchant of pH 10.6 containing an amount of diffused abrasive grains of colloidal silica with a grain size of 0.05 μm.

At that time, as described above, during revolution of the carrier plate 11, the front and the back surfaces of the silicon wafer W are polished while a part of the outer periphery of the silicon wafer W being protruded beyond the soft non-woven fabric pads 14, 15 by an amount of displacement "Q" (see FIG. 1 (B)) . With such polishing applied to the silicon wafer W, the outer periphery of the wafer under polishing is polished while passing through the non-polishing area at each time when the silicon wafer W is rotated by a predetermined angle. It is to be noted that in a prior art polisher employing no protrusion of the wafer, a greater polishing volume has been observed in the outer peripheral region than in the central region of the wafer. In contrast to this, in this double-sided polisher 10 according to the present invention, the contact area per unit rime of the wafer outer periphery with the polishing cloth 11 is reduced as compared to the central region of the wafer. As a result, this can help improve the degree of flatness of the wafer.

Further in this double-sided polisher 10, the carrier plate 11 is driven to make a circular motion associated with no rotation on its own axis during the double-sided polishing thus to polish both of the front and the back surfaces of the wafer. Since such a special motion of the carrier plate 11 has been employed to carry out the double-sided polishing of the silicon wafer W, therefore a uniform polishing is provided over almost entire area in the front and the back surfaces of the wafer.

Here is given a report on a variation of the polish-sagging in the outer periphery of the wafer for different amount of protrusions of the wafer W beyond the polishing cloth applied to the double-sided polishing actually carried out by using the double-sided polisher 10 according to this embodiment of the present invention. FIG. 12 is a graph showing the polish-sagging in the outer periphery of the wafer as a function of the length of protrusion of the outer periphery of the wafer during polishing of the wafer in the method of polishing semiconductor wafers using the double-sided polisher according to a fourth embodiment of the present invention.

As is obvious from this graph, the length of protrusion of the outer periphery of the wafer lower than 3 mm indicates the greater polish-sagging in the outer periphery. In contrast, the length of protrusion of the outer periphery of the wafer equal to 3 mm or more indicates that the polish-sagging has remained steady in a low value, leading a preferable result obtained.

According to the present invention, since the semiconductor wafer is polished while a part of the wafer outer periphery being protruded beyond the polishing cloths during polishing of the wafer, a contact area per unit time of the wafer outer periphery with the polishing cloth maybe reduced as compared to the central region of the wafer, and therefore, the polish-sagging in the wafer outer periphery may be suppressed and thus to improve the degree of flatness of the wafer.

Especially, in the present invention, since the semiconductor wafer is polished while driving the carrier plate to make a circular motion associated with no rotation on its axis, therefore the polishing can be provided uniformly in almost entire area of both of the front and the back surfaces of the wafer, and thereby the polish-sagging in the outer periphery of the wafer can be further reduced.

What is claimed is:

1. A method for polishing a semiconductor wafer by using a double-sided polisher, in which a semiconductor wafer is held in a wafer holding through-hole formed in a carrier plate, and said carrier plate is moved in a circle within a plane parallel with a surface of said carrier plate, without said carrier plate rotating on its own axis, between an upper surface plate and a lower surface plate having polishing cloths extending over opposing surfaces thereof while supplying a polishing agent to said semiconductor wafer, so that a front and a back surface of said semiconductor wafer can be polished simultaneously, said method being characterized in that said semiconductor wafer is polished in a state where a part of an outer periphery of said semiconductor wafer is protruded by 3 - 15 mm beyond said polishing cloths.

2. A method for polishing a semiconductor wafer by using a double-sided polisher in accordance with claim 1, in which said semiconductor wafer has only one mirror-finished surface and said polishing agent is supplied from an opposite side of said mirror-finished surface of said semiconductor wafer.

3. A method for polishing a semiconductor wafer by using a double-sided polisher in accordance with claim 1 or 2, in which said polishing agent is supplied from a supply hole located on an orbit of the motion of said semiconductor wafer held in said carrier plate.

4. A method for polishing a semiconductor wafer by using a double-sided polisher in accordance with claim 1 or 2, in which said semiconductor wafer is coated with an oxide film on either one of the surfaces.

5. A method for polishing a semiconductor wafer by using a double-sided polisher in accordance with claim 3, in which said semiconductor wafer is coated with an oxide film on either one of the surfaces.

* * * * *